US006283728B1

(12) United States Patent
Tomoiu

(10) Patent No.: US 6,283,728 B1
(45) Date of Patent: Sep. 4, 2001

(54) GAS POWERED ROTARY ENGINE AND COMPRESSOR

(76) Inventor: Constantin Tomoiu, 11 Old South Ave., Stratford, CT (US) 06497

( * ) Notice: Subject to any disclaimer, the term of this patent is extended or adjusted under 35 U.S.C. 154(b) by 0 days.

(21) Appl. No.: 09/478,049

(22) Filed: Jan. 5, 2000

(51) Int. Cl.[7] ..... F04B 17/00; F01C 13/04; F01C 1/344; F04C 18/38

(52) U.S. Cl. ..... 417/405; 418/3; 418/69; 418/213; 418/246; 418/249; 418/263

(58) Field of Search ..... 417/405; 418/69, 418/210, 246, 249, 263, 247, 213, 3

(56) References Cited

U.S. PATENT DOCUMENTS

| | | | | |
|---|---|---|---|---|
| 440,120 | * | 11/1890 | Forsythe | 418/263 |
| 1,038,075 | * | 9/1912 | Berrenberg | 417/405 |
| 2,607,298 | * | 8/1952 | Nicolas | 418/263 |
| 3,433,169 | * | 3/1969 | Graetz | 418/263 |
| 4,014,298 | | 3/1977 | Schulz | 123/229 |
| 4,448,161 | | 5/1984 | Tseng | 123/237 |
| 4,620,514 | | 11/1986 | Tseng | 123/202 |
| 4,860,704 | | 8/1989 | Slaughter | 123/227 |
| 5,247,916 | | 9/1993 | Riney | 123/222 |
| 5,360,319 | * | 11/1994 | Swain et al. | 418/69 |

FOREIGN PATENT DOCUMENTS

| | | | | |
|---|---|---|---|---|
| 810898 | * | 8/1951 | (DE) | 417/405 |
| 0180690 | * | 5/1986 | (EP) | 418/249 |

* cited by examiner

*Primary Examiner*—John J. Vrablik
(74) *Attorney, Agent, or Firm*—Fattibene & Fattibene; Paul A. Fattibene; Arthur T. Fattibene

(57) ABSTRACT

A plurality of rotary assemblies driven by gas pressure having internal cam activated retractable gates selectively coupled to a rotary compressor. The rotary compressor is selectively coupled through a clutch to a shaft. The shaft is rotated by the plurality of rotor engine assemblies that are driven by gas pressure. A gate is coupled to a cam follower bearing that rides on an internal surface of the rotor housing, causing the gates to form chambers within the rotor as well as move out of position to pass a chamber divider. The shaft may be coupled to a load to do work.

8 Claims, 3 Drawing Sheets

GAS POWERED ROTARY ENGINE AND COMPRESSOR

FIELD OF THE INVENTION

The present invention relates generally to a rotary engine driven by gas pressure, and particularly to a smooth operating efficient rotary engine coupled to a compressor.

BACKGROUND OF THE INVENTION

There are many different types of rotary engines having relatively complex valves or gating mechanisms. Many of these rotary engines have rotating members that are eccentrically positioned on a shaft so as to form chambers within a housing. An example of such a rotary engine is disclosed in U.S. Pat. No. 5,247,916 entitled "Rotary Engine", and issuing to Riney on Sep. 28, 1993. Other rotary engines may have a variety of valves which are mechanically complicated and difficult to control or time that may require periodic adjustment. For example, a rotary engine having a hinged valve arrangement is disclosed in U.S. Pat. No. 4,860,704 entitled "Hinge Valved Rotary Engine With Separate Compression And Expansion Sections" issuing to Slaughter on Aug. 29, 1989. Other rotary engines may have gate systems or valves that are partially external to the rotary engine, resulting in a relatively large rotary engine that is not compact or of convenient shape. For example, the rotary engine disclosed in U.S. Pat. No. 4,014,298 entitled "Concentric Rotary Engine" issuing to Schulz on Mar. 29, 1977. While these prior rotary engines are suitable for the applications for which they have been designed, they are often relatively complex and are not easily packaged or conducive to a compact design that can easily fit within a small space. Additionally, the relatively complicated gating or valve mechanisms often result in timing problems, jamming, or the necessity of frequent and inconvenient adjustments. Additionally, often it is not convenient to couple the output of the rotary engine to other devices so that other types of work may be performed with the rotational movement created by the rotary engine. Accordingly, there is a need for a rotary engine that is well balanced and runs smoothly, that needs little adjustment, and that can be placed in a compact space. There is also a need for a rotary engine that facilitates coupling to other devices for performing work.

SUMMARY OF THE INVENTION

The present invention is a rotary engine particularly adapted to include a plurality of rotary assemblies, with each rotary assembly having a chamber formed within a rotor housing with internal retractable cam activated radial gates. Each rotor assembly is coupled to a shaft to provide rotational work. A rotary compressor is coupled to the shaft of the rotary engine through a clutch which may be selectively engaged with the rotary compressor.

Accordingly, it is an object of the present invention to provide an efficient, smooth operating rotary engine that is operated by pressurized gas.

It is a further object of the present invention to combine a rotary engine with a rotary compressor.

It is an advantage of the present invention that it is well balanced and quiet running.

It is a further advantage of the present invention that it requires infrequent adjustments.

It is a feature of the present invention that the rotary engine has internal cam activated radial gating.

It is a feature of the present invention that a plurality of rotary engines may be coupled with a common shaft to a rotary compressor that is selectively engaged by a clutch.

These and other objects, advantages, and features will become readily apparent in view of the following detailed description.

DETAILED DESCRIPTION OF THE PREFERRED EMBODIMENTS

Figure 1:
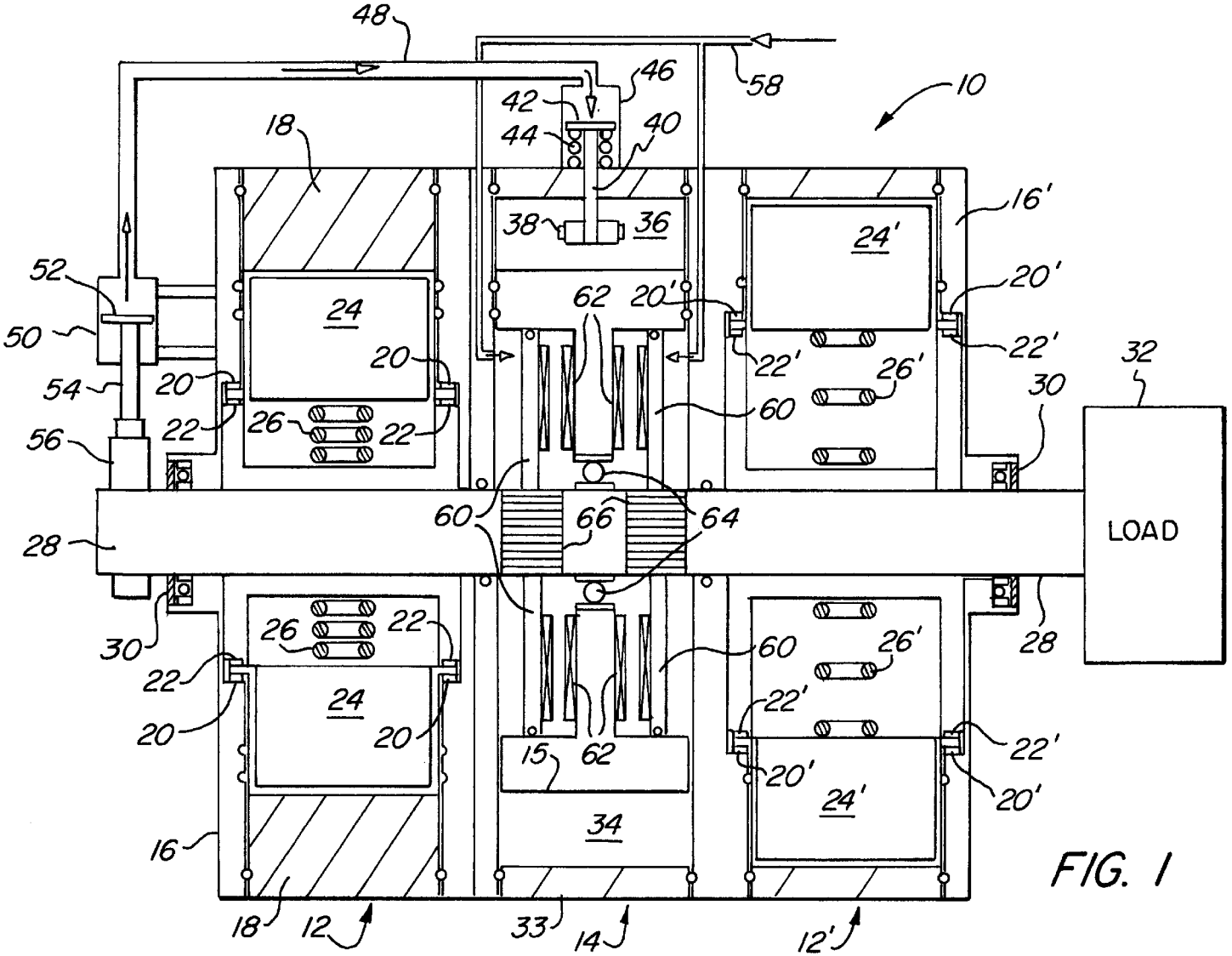
FIG. 1 schematically illustrates the present invention.

FIG. 1 schematically illustrates the present invention. The rotary engine and compressor 10 is comprised of a first rotary assembly 12 and a second rotor assembly 12'. The first rotary assembly 12 and the second rotor assembly 12' are functionally similar. A compressor 14 is positioned between the first rotor assembly 12 and the second rotor assembly 12'. A chamber is formed within each of the rotor housings 16 and 16'. Chamber dividers 18 form a part of the housing or are attached to the housing to divide the rotor housing 16 into two chambers. The second rotor assembly 12' has the chamber dividers 18 rotated 90°. Therefore, they are not illustrated on the second rotor assembly 12'. Formed on the interior surface of the rotor housings 16 and 16' are rotor housing cam surfaces 20 and 20'. Gates 24 and 24' have cam follower bearings 22 and 22' which follow the rotor housing cam surfaces 20 and 20'. The cam surfaces 20 and 20' may form a continuous closed loop. Springs 26 and 26' bias the gates 24 and 24' against the interior surfaces of the rotor housings 16 and 16', including the chamber divider 18. The rotor is coupled to a shaft 28. Bearings 30 are used to hold the shaft 28. A load 32 may also be coupled to the shaft 28. Positioned between the first rotor assembly 12 and the second rotor assembly 12' is a compressor 14. Compressor housing 33 forms a compressor chamber 34 with compressor rotor 15 rotating therein. Compressor gate 36 is pivotally connected by pivot 38 to a rod 40. The rod 40 is coupled to a hydraulic piston 42 and is biased upward by spring 44. Hydraulic pressure within the cylinder 46 biases the compressor gate 36 in a closed position. Hydraulic line 48 provides hydraulic pressure to the cylinder 46 and piston 42. The hydraulic line 48 is coupled to a cylinder 50 and piston 52. The piston 52 is activated by a rod 54 that is attached to a cam follower housing 56 which is in contact with the end of shaft 28. The compressor rotor 15 is permitted to remain stationary as the shaft 28 rotates within bearings 64. A clutch is used to selectively connect the compressor 14 to the shaft 28 as it rotates, driven by the rotator assemblies 12 and 12'. Clutch plates 60 and mating clutch plates 62 are controllably engaged by hydraulic pressure being supplied by hydraulic line 58. The clutch plates 60 are coupled to the shaft 28 by splines 66.

Figure 2A:
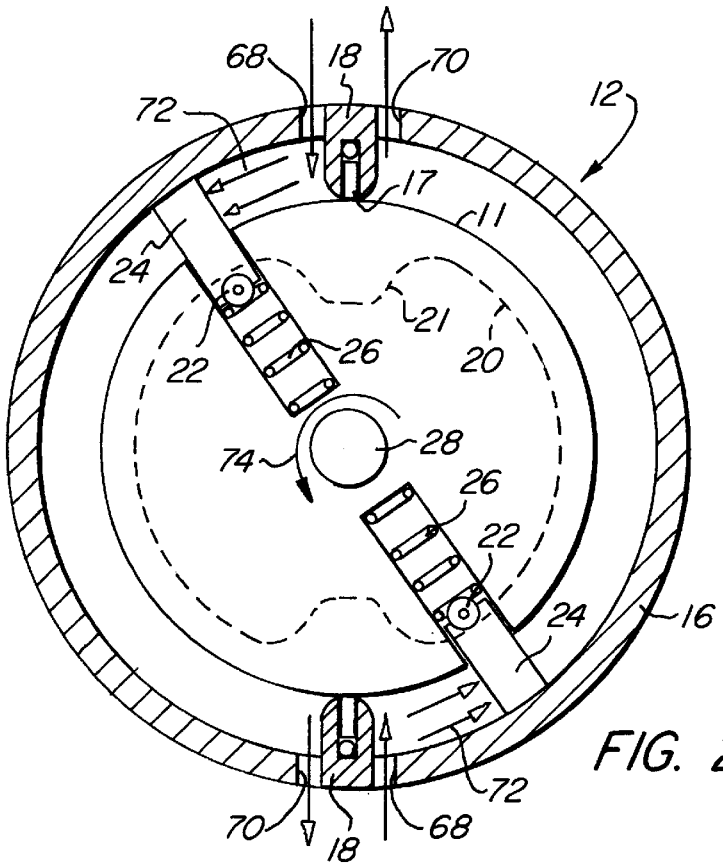
FIG. 2A schematically illustrates the operation of one of the rotary engines in a first position.

FIG. 2A illustrates one of the rotor assemblies 12 in a first position. Gas inlets 68 permit pressurized gas to enter the chambers 72. Exhaust outlets or vents 70 prevent the buildup of pressure within the chambers 72 on the other side of gates 24.

Figure 2B:
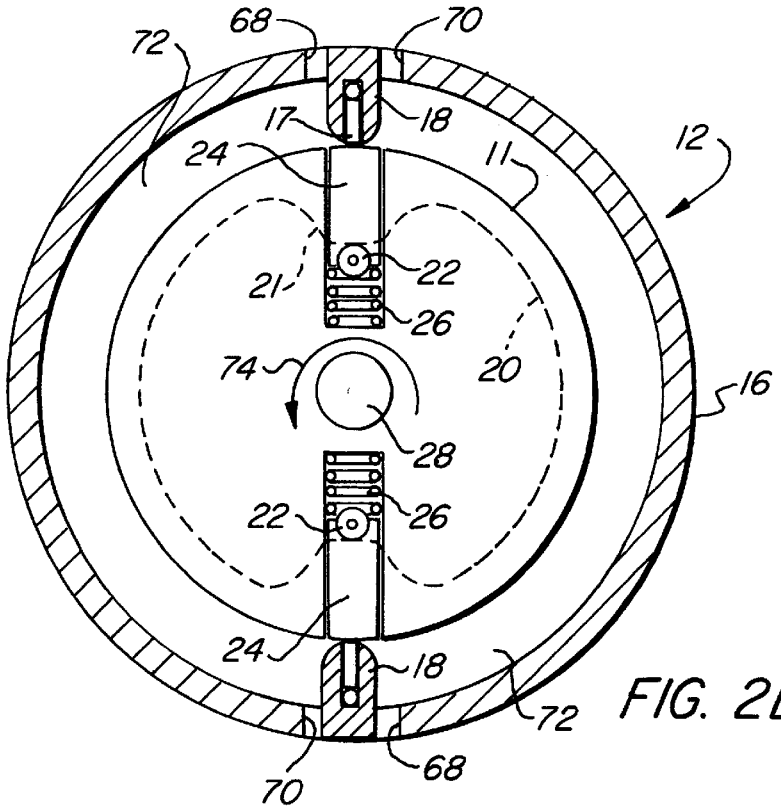
FIG. 2B illustrates the operation of one of the rotary engines in a second position.

FIG. 2B illustrates a rotor assembly 12 with the rotor 11 in another position. In this position, the gates 24 are retracted within the body of the rotor 11. The gates 24 are retracted by the cam follower bearing 22 riding on the raised portion 21, causing spring 26 to compress. The gate 24 is then retracted within the body of the rotor 11, permitting it to pass the chamber divider 18. Chamber divider 18 has a seal 17. Seal 17 may be made of Teflon or any durable surface or material that slides easily over the surface of rotor 11 and the gate 24.

The operation of the rotor assembly 12 can readily be appreciated with reference to FIGS. 2A and 2B. When gas under pressure is provided to inlet 68, it is caused to drive the gate 24 and the attached rotor 11 in the direction of arrow 74. Gate 24 is in a raised position contacting the inner surface of the rotor housing 16, effectively sealing the chamber 72. Exhaust outlet or vent 70 assures that the rotor 11 is permitted to rotate easily and that pressure does not build up within chamber 72 on this side of the gate 24. Cam follower bearing 22 follows the rotor housing cam surface 20 until raised portion 21 is encountered causing the gate 24 to retract within the rotor 11 so that chamber divider 18 may be passed without striking the gate 24. It should be appreciated that while two chambers are illustrated and two gates for each rotor assembly, clearly additional gates and chambers may be utilized as desired, depending upon the application. For example, the principles of the present invention can easily be extended to the use of four gates and four chambers for each rotor assembly. The retraction of the gates into the rotor 11 creates a very compact design. Additionally, the use of a rotor housing cam surface 20 in combination with the raised portions 21 and cam follower bearing 22 reduce wear and potential jamming or damage to the gates 24 upon passing the chamber dividers 18. Additionally, by keeping the gate mass close to the center of rotation, rotational inertia is reduced adding to the efficiency and response of the rotary engine.

Figure 3A:
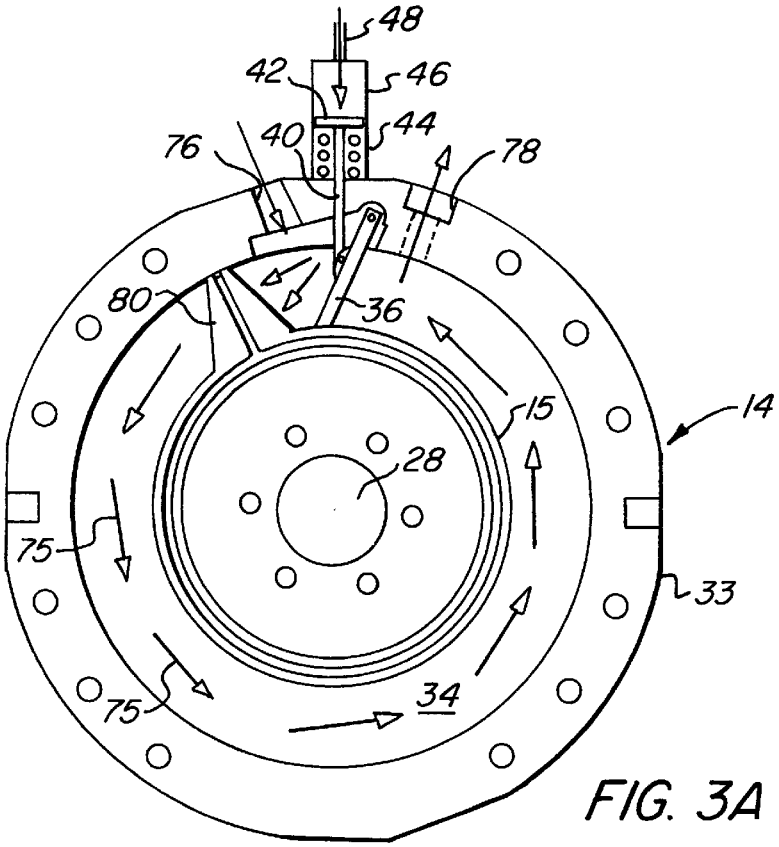
FIG. 3A illustrates the operation of the compressor coupled to the plurality of rotary engines illustrated in FIG. 1.

FIG. 3A more clearly illustrates the operation of the compressor 14 illustrated in FIG. 1. Compressor 14 is comprised of a compressor housing 33 with a compressor rotor 15 mounted on shaft 28. The compressor rotor 15 has a chamber divider 80 thereon. A compressor gate 36 is pivotally attached to rod 40 and piston 42. The gate 36 is normally biased open by spring 44. When gate 36 is closed, gas is compressed within compressor chamber 34 as shaft 28 rotates the compressor rotor 15. Gas inlet or vent 76 permits clean gas to enter the compressor chamber 34 as the compressor rotor 15 rotates in the direction of arrows 75. The clean compressed gas formed by the compressor 14 has beneficial uses and can be applied to combustion engines that may require high pressure for combustion.

Figure 3B:
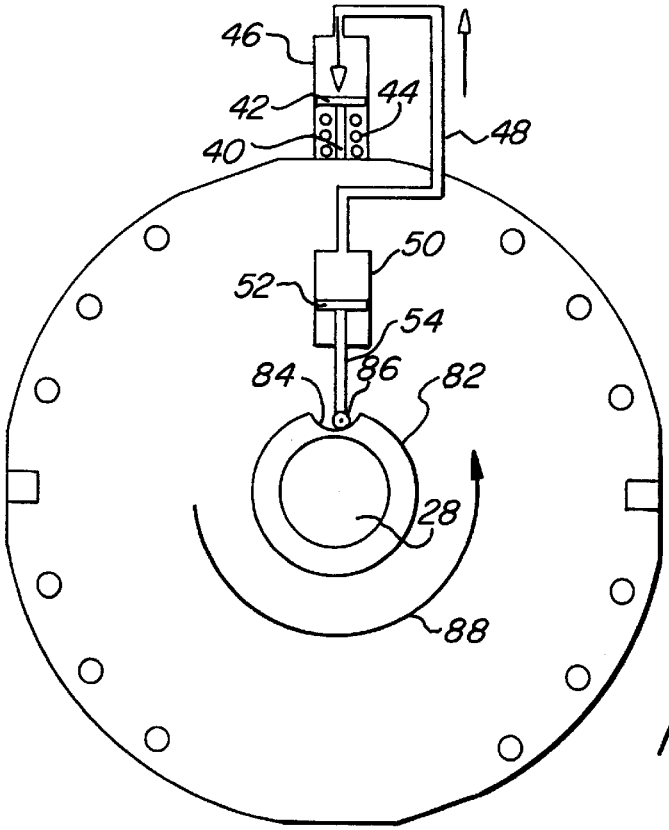
FIG. 3B illustrates the operation of the gate mechanism in the compressor illustrated in FIG. 3A.

FIG. 3B illustrates the operation of the hydraulics for moving compressor gate 36. The end of shaft 28 has a cam surface thereon, including a dip or recess 84. A cam follower 86 formed on the end of the rod 54 is coupled to piston 52 within the hydraulic cylinder 50. The dip or recess 84 is positioned within shaft 28 such that when the cam follower 86 encounters the dip 84, piston 52 is caused to drop, reducing the hydraulic pressure within the cylinder 46 causing the piston 42 to be advanced upward by spring 44. Piston 42 being attached to rod 40 causes the gate 36 to be moved out of the chamber of the compressor 14.

It should readily be appreciated that the present invention provides a well balanced, smooth running rotary engine that may have a plurality of rotors used to turn a shaft. The shaft may be coupled to a rotary compressor that can efficiently compress a gas to a high pressure for a multitude of uses. Additionally, the shaft coupled to the rotor assemblies may be coupled to a load to produce work. The rotary engine and compressor combination of the present invention has a design that is very conducive to fitting within a small space. The present invention may be particularly applicable to engines adapted to drive automobiles, other devices requiring rotational work, or in situations where clean high-pressure gas is used with combustion engines or for other purposes. While the preferred embodiments have been illustrated and described, it will be obvious to those skilled in the art that modifications may be made without departing from the spirit and scope of this invention.

What is claimed is:

1. A plurality of rotary engines and a compressor comprising:

a first rotor housing;

a first rotor placed within said first rotor housing;

a first gate retractably positioned within said first rotor;

a first cam surface placed in said first rotor housing;

a first cam follower attached to said first gate and contacting said first cam surface, whereby said first gate is caused to move radially within said first rotor forming a first chamber between said first rotor housing and said first rotor;

a second rotor housing;

a second rotor placed within said second rotor housing;

a second gate retractably positioned within said second rotor;

a second cam surface placed in said second rotor housing;

a second cam follower attached to said second gate and contacting said second cam surface, whereby said second gate is caused to move radially within said second rotor forming a second chamber between said second rotor housing and said second rotor;

a shaft, said first and second rotors mounted on said shaft;

a compressor housing;

a compressor rotor placed within said compressor housing and coupled to said shaft;

a compressor gate placed between said compressor housing and said compressor rotor forming a compressor chamber; and a compressor gate drive coupled to said shaft, whereby said compressor gate is caused to move between said compressor housing and said compressor rotor so as to form the compressor chamber, whereby the plurality of rotary engines drive said shaft causing the compressor to create high pressure gas.

2. A plurality of rotary engines and compressor as in claim 1 further comprising:

a clutch coupling said compressor rotor to said shaft.

3. A plurality of rotary engines and compressor as in claim 1 wherein:

said first and second cam surfaces are closed loops.

4. A plurality of rotary engines and compressor as in claim 1 further comprising:

a first spring coupled to said first gate biasing said first gate away from said first rotor; and a second spring coupled to said second gate biasing said second gate away from said second rotor.

5. A plurality of rotary engines and compressor as in claim 1 wherein:

said compressor gate drive is hydraulically operated.

6. A plurality of rotary engines and compressor as in claim 1 wherein:

said compressor housing is positioned between said first rotor housing and said second rotor housing.

7. A plurality of rotary engines and a compressor comprising:

a first cylindrical rotor housing;

a first chamber divider extending radially from said first cylindrical rotor housing;

a second chamber divider extending radially from said first cylindrical rotor housing opposite said first chamber divider;

a first cylindrical rotor placed within said first cylindrical rotor housing forming a first and second chamber between said first and second chamber dividers;

a first gate retractably positioned within said first cylindrical rotor;

a second gate retractably positioned within said first cylindrical rotor positioned opposite said first gate;

a first cam surface placed in said first cylindrical rotor housing;

a first raised portion placed on said first cam surface opposite said first chamber divider;

a second raised portion placed on said first cam surface opposite said second chamber divider;

a first cam follower attached to said first gate and contacting said first cam surface, whereby said first gate is caused to move radially within said first rotor when said first cam follower contacts said first and second raised portions;

a second cam follower attached to said second gate and contacting said first cam surface, whereby said second gate is caused to move radially within said first rotor when said second cam follower contacts said first and second raised portions;

a second cylindrical rotor housing;

a third chamber divider extending radially from said second cylindrical rotor housing;

a fourth chamber divider extending radially from said second cylindrical rotor housing opposite said third chamber divider;

a second cylindrical rotor placed within said second cylindrical rotor housing forming a third and fourth chamber between said third and fourth chamber dividers;

a third gate retractably positioned within said second cylindrical rotor;

a fourth gate retractably positioned within said second cylindrical rotor positioned opposite said third gate;

a second cam surface placed in said second cylindrical rotor housing;

a third raised portion placed on said second cam surface opposite said third chamber divider;

a fourth raised portion placed on said second cam surface opposite said fourth chamber divider;

a third cam follower attached to said third gate and contacting said second cam surface, whereby said third gate is caused to move radially within said second rotor when said third cam follower contacts said first and second raised portions;

a fourth cam follower attached to said fourth gate and contacting said second cam surface, whereby said fourth gate is caused to move radially within said second rotor when said fourth cam follower contacts said third and fourth raised portions;

a shaft, said first and second rotors mounted on said shaft;

a compressor housing placed between said first and second rotor housings;

a compressor rotor placed within said compressor housing;

a clutch selectively coupling said compressor rotor to said shaft;

a compressor gate placed between said compressor housing and said compressor rotor forming a compressor chamber; and a compressor gate drive coupled to said shaft, whereby said compressor gate is caused to move between said compressor housing and said compressor rotor so as to form the compressor chamber, whereby the plurality of rotary engines drive said shaft causing the compressor to create high pressure gas.

8. A rotary engine and compressor comprising:

a first rotary engine;

a second rotary engine;

a compressor placed between said first and second rotary engines;

a compressor gate pivotally attached within said compressor, whereby a compressor chamber is formed between a compressor rotor and said compressor gate;

a shaft connected to said first rotary engine and said second rotary engine;

a clutch selectively coupling said compressor to said shaft;

a cam surface on the end of said shaft;

a cam follower contacting said cam surface; and an hydraulic coupling attached to said cam follower at one end and said compressor gate at the other end, whereby said compressor gate is selectively caused to move out of the compressor chamber.

* * * * *